US010724757B2

(12) United States Patent
Froehlich et al.

(10) Patent No.: US 10,724,757 B2
(45) Date of Patent: Jul. 28, 2020

(54) REFRIGERATION SYSTEM AND DEVICE

(71) Applicant: Prince Castle LLC, Carol Stream, IL (US)

(72) Inventors: Wayne Froehlich, Wheaton, IL (US); Luca Cantorelli, Carnago (IT); Roberto Manzari, Carnago (IT)

(73) Assignee: Prince Castle LLC, Carol Stream, IL (US)

( * ) Notice: Subject to any disclaimer, the term of this patent is extended or adjusted under 35 U.S.C. 154(b) by 170 days.

(21) Appl. No.: 15/890,872

(22) Filed: Feb. 7, 2018

(65) Prior Publication Data

US 2018/0224151 A1 Aug. 9, 2018

Related U.S. Application Data

(60) Provisional application No. 62/455,925, filed on Feb. 7, 2017.

(51) Int. Cl.

| | |
|---|---|
| ***F24F 11/523*** | (2018.01) |
| ***F25D 29/00*** | (2006.01) |
| ***F25D 11/04*** | (2006.01) |
| ***F25D 17/04*** | (2006.01) |
| *F25D 23/02* | (2006.01) |

(52) U.S. Cl.

CPC ..... *F24F 11/523* (2018.01); *F25D 11/04* (2013.01); *F25D 17/04* (2013.01); *F25D 29/003* (2013.01); *F25D 29/008* (2013.01); *F25B 2700/151* (2013.01); *F25D 23/028* (2013.01); *F25D 2400/08* (2013.01); *F25D 2400/36* (2013.01); *F25D 2400/40* (2013.01); *F25D 2500/04* (2013.01); *F25D 2500/06* (2013.01); *F25D 2700/02* (2013.01); *F25D 2700/08* (2013.01); *F25D 2700/12* (2013.01); *F25D 2700/123* (2013.01)

(58) Field of Classification Search

CPC ..... F25D 29/008; F25D 2400/36; F25D 2400/361; F25D 2500/04; F25D 2700/08; F25D 2700/12; F24F 11/523

See application file for complete search history.

(56) References Cited

U.S. PATENT DOCUMENTS

| | | | | |
|---|---|---|---|---|
| 6,240,737 | B1 * | 6/2001 | Albiez | F25B 27/002 62/228.5 |
| 2004/0187503 | A1 * | 9/2004 | Davis | F25D 17/065 62/180 |
| 2012/0217254 | A1 * | 8/2012 | Cho | F25D 29/00 220/592.02 |
| 2013/0076488 | A1 * | 3/2013 | Oh | F25D 29/00 340/6.1 |

(Continued)

*Primary Examiner* — Marc E Norman

(74) *Attorney, Agent, or Firm* — Andrus Intellectual Property Law, LLP

(57) ABSTRACT

A refrigeration device includes a cabinet defining a compartment and is operable to control an environment within the compartment. At least one sensor is associated with the compartment. A processor receives compartment data from the at least one sensor associated with the compartment. The processor operates an environmental control system of the refrigeration device according to the compartment data. The processor is communicatively connected to and operates a graphical display of an input module to present compartment data in a graphical user interface of the input module.

14 Claims, 8 Drawing Sheets

(56) References Cited

U.S. PATENT DOCUMENTS

2016/0162715 A1* 6/2016 Luk ..... F25D 29/005
235/385
2017/0262973 A1* 9/2017 Johnston ..... F25D 29/00

* cited by examiner

REFRIGERATION SYSTEM AND DEVICE

CROSS-REFERENCE TO RELATED APPLICATION

The present application claims priority of U.S. Provisional Patent Application No. 62/455,925, filed on Feb. 7, 2017, the content of which is hereby incorporated herein by reference in its entirety.

BACKGROUND

The present disclosure is related to the field of refrigeration. More particularly, this present disclosure relates to refrigeration apparatus and systems. Refrigeration apparatus and systems can be a significant investment for restaurant and food service operators. Therefore, systems and apparatus for refrigeration that provide advantages in adaptability, operation, energy efficiency, service/maintenance, and/or inventory management are desirable. The apparatus and systems as described herein seek to address this and other needs in refrigeration systems.

BRIEF DISCLOSURE

An exemplarily embodiment of a refrigeration device includes a cabinet defining a compartment. The refrigeration device is operable to control an environment within the compartment. The refrigeration device includes an input module which includes a graphical display. At least one sensor is provided within the compartment. A processor receives compartment data from the at least one sensor provided within the compartment and operates an environmental control system of the refrigeration device according to the compartment data. The processor is communicatively connected to and operates the graphical display to present compartment date in a graphical user interface of the input module.

An exemplary embodiment of the refrigeration device further includes that the at least one sensor is a plurality of temperature sensors. The plurality of temperature sensors are distributed about the compartment. The processor receives the compartment data from the plurality of temperature sensors. The processor calculates a temperature gradient within the compartment and operates the environmental control system based upon the temperature gradient. In a still further exemplary embodiment, the processor identifies localized temperature differences within the temperature gradient. Additionally, a door may be hingedly connected to the cabinet and a door status sensor operates to provide a signal to the processor indicative if the door is open. The processor further operates the environmental control system based upon a detected door open event to adjust weight given to localized temperature differences within the gradient during the detected door open event.

In still further exemplarily embodiments at least one product identification sensor is associated with the cabinet. The processor produces an indication of the food products within the compartment based upon date from the at least one product identification sensor. In an exemplary embodiment, the at least one product identification sensor may include a camera and/or an RFID sensor.

In a still further exemplarily embodiment, the environmental control system of the refrigeration device further includes a compressor system. The compressor system is operable to perform a refrigeration cycled to reduce the temperature within the compartment. An operational sensor is provided relative to the compressor system. The operational sensor senses a parameter of the compressor system. The operation sensor provides the sensed parameter to the processor. The processor determines a functional condition of the compressor system based upon the sensed parameter.

In an exemplary embodiment of a refrigeration system, a first refrigeration device which includes a cabinet defining a compartment and an environmental control system operable to control an environment within the compartment. At least one sensor is provided within the compartment. A processor receives compartment date from the sensor associated with the compartment. The processor operates an environmental control system of the refrigeration device according to the compartment data and is communicatively connected to and operated the graphical display to present compartment data in a graphical user interface of the input module. A refrigeration management system is communicatively connected to the refrigeration device. The refrigeration management system includes an RMS processor that receives the compartment data from the refrigeration system. The refrigeration management system processes the compartment data to identify an alarm condition within the compartment and produces an alarm.

DETAILED DISCLOSURE

Figure 1:
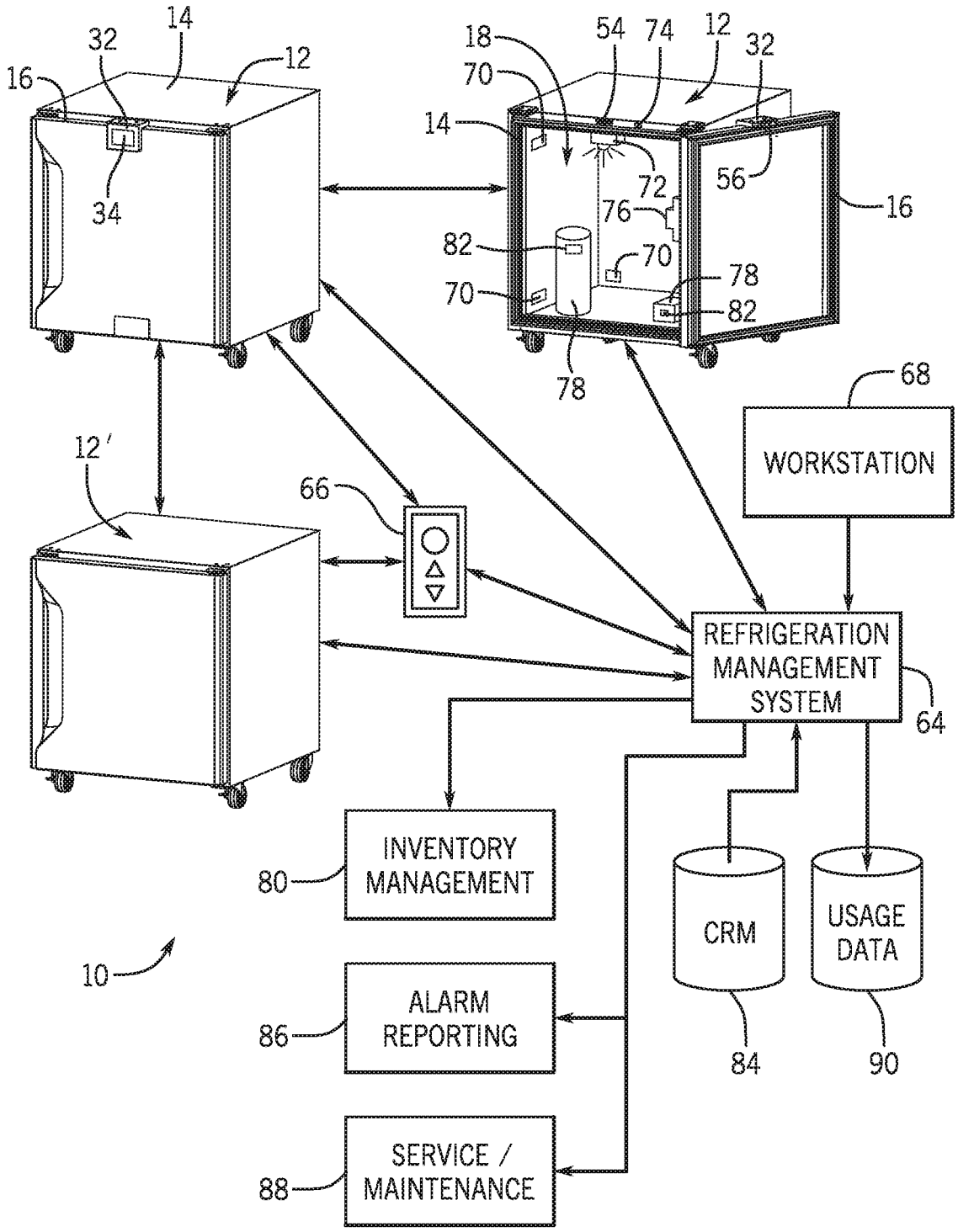
FIG. 1 depicts an exemplary embodiment of a refrigeration system.
Figure 2:
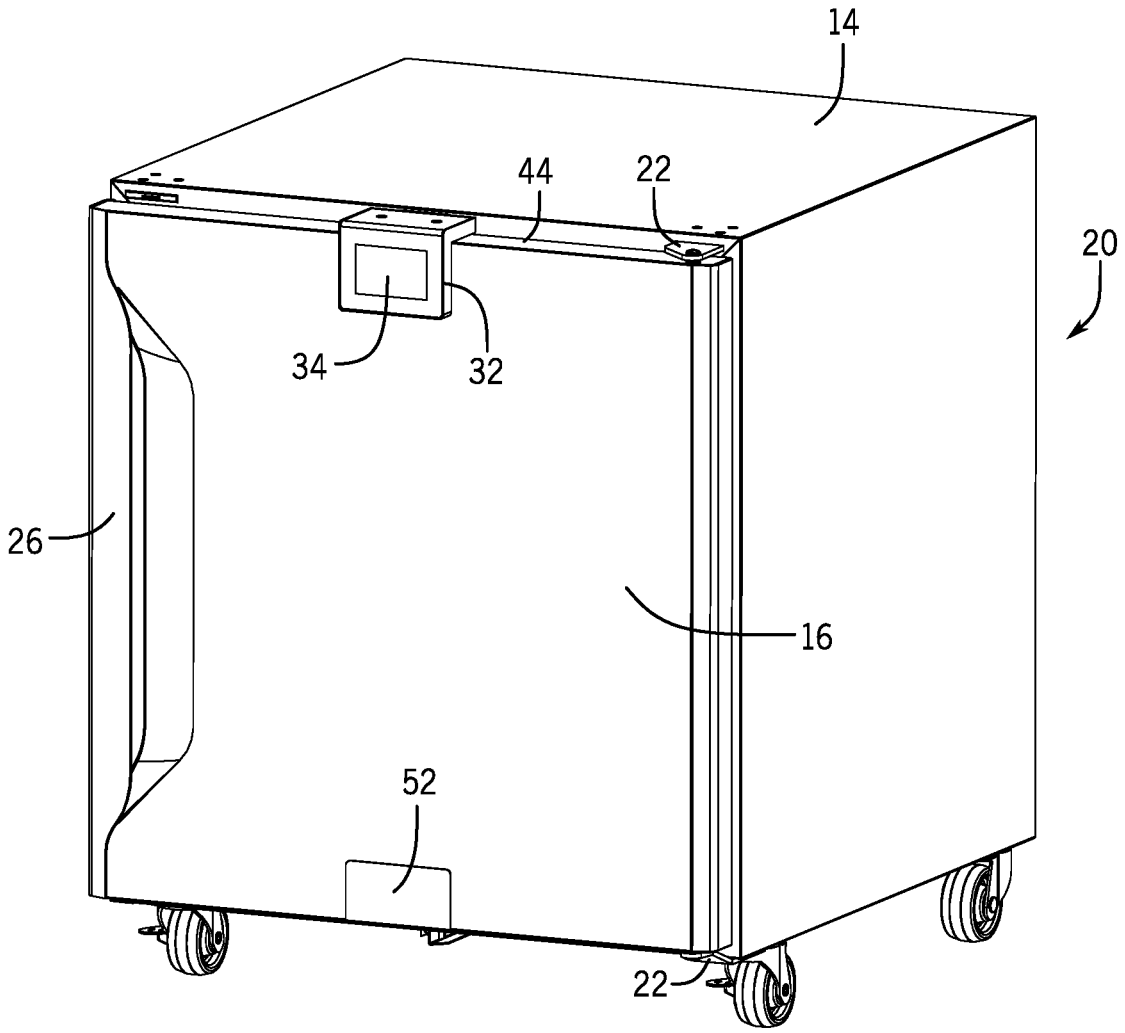
FIG. 2 depicts an exemplary embodiment of an undercounter freezer.

FIG. 1 depicts an exemplary embodiment of a refrigeration system 10. The refrigeration system 10 includes a plurality of refrigeration devices 12. As described herein, the refrigeration devices 12 may take a variety of forms suited for particular uses and/or use cases while exemplarily including the same or similar features as described herein. FIG. 2 depicts an exemplary and non-limiting embodiment of the refrigeration devices 12 as may be used in exemplary embodiments of the refrigeration system 10. It will be understood that in embodiments, the refrigeration system 10 may include a variety of different refrigeration devices 12 within a kitchen or food preparation setting. Still further exemplary embodiments of refrigeration devices include refrigerated liquid dispensers, for example the Majestic series of Milk dispensers available from Silver King LLC, or as described by the commonly owned U.S. Pat. No. 8,844,768, entitled "Liquid Dispenser with Storage Tanks," which is hereby incorporated by reference herein in its entirety. FIG. 2 exemplarily depicts a refrigeration device of an undercounter freezer. Other exemplary and non-limiting embodiments of refrigeration devices include refrigerated preparation tables, pizza prep tables, chef base prep tables, and upright refrigerators. It will be recognized that these refrigeration devices are merely exemplary and other refrigeration devices will be recognized by a person of ordinary skill in the art in view of the present disclosure. Furthermore, it will be recognized that any of the above disclosed embodiments may be implemented as either freezers or refrigerators or similarly other embodiments of refrigeration devices may also be configured as such.

Figure 3:
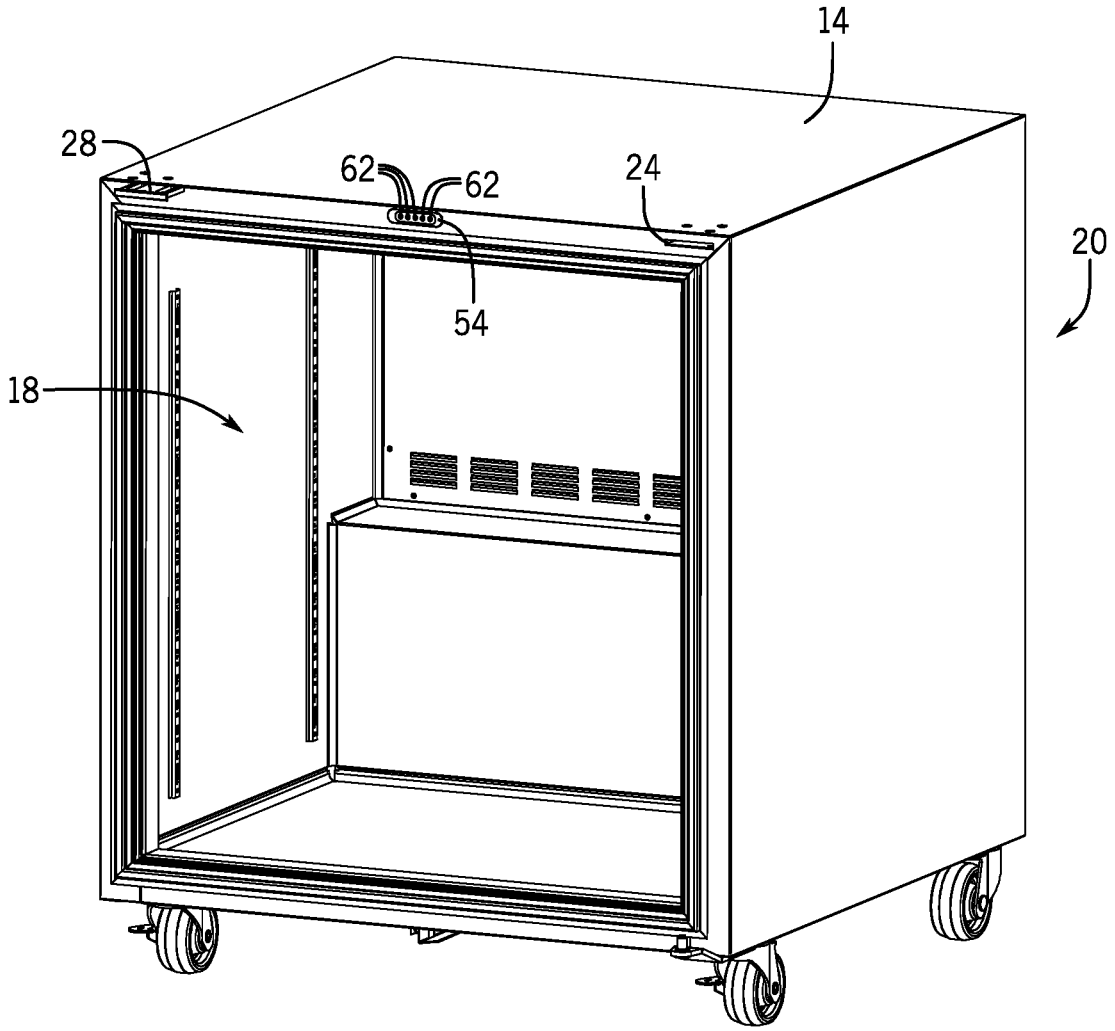
FIG. 3 depicts the undercounter freezer of FIG. 2, with the door removed.

FIGS. 2-7 depict exemplary features of a refrigeration device. The refrigeration device is exemplarily depicted as an undercounter freezer 20 although it will be recognized that the features as described herein may be implemented on any refrigeration device, including those as described in the present application. The undercounter freezer 20 includes a cabinet 14 and a door 16. FIG. 3 depicts the freezer 20, with the door 16 removed. This shows that the door 16 opens to provide access to a compartment 18. The compartment 18 is environmentally controlled, including, but not limited to control with respect to temperature by a cooling system (not depicted) of the undercounter freezer. The door 16 is secured to the cabinet 14 by hinge plates 22 (FIG. 2). The hinge plate 22 is inserted within a hinge slot 24 configured to receive the hinge plate 22 (FIG. 3).

As depicted in FIG. 2, the door 16 is exemplarily configured in a right hand open configuration in which a handle 26 of the door 16 is positioned on a left hand side of the door 16 and the hinge plates 22 are secured to the cabinet 14 to provide an axis of pivot about which the door 16 opens along the right hand side of the door 16.

In embodiments, the door 16 is reversible in its orientation for opening, exemplarily by disconnecting the hinge plates 22 from the hinge bracket which may comprise a slot 24 in the cabinet 14 and a portion of the cabinet 14 internal to the slot 24 to which the hinge plate is removably secured. Rotating the door 16 by 180° and securing the hinge plates 22 to the opposite side of the cabinet 14, exemplarily in hinge bracket 28. While not depicted herein, it will be recognized that similar hinge slots may be positioned at the bottom of the cabinet 14, including, but not limited to a slidable or other configuration of mount configured to receive the hinge plates 22 secured to the bottom of the cabinet 14.

The exemplary embodiment of a configurable door further provides an input module 32 which is mounted to the door 16. In the manners as described herein, the input module 32 provides a solution whereby no wired or electronic connections are necessary within the door itself, or between the door 16 and the cabinet 14. This facilitates complete removal of the door for changing the handedness of the door orientation and also to simplify door construction and provide a door construction with improved thermal properties.

The input module 32, exemplarily includes a graphical display 34 the use and operation of which will be described in further detail herein. The graphical display 34 is exemplarily operable to present a graphical use interface (GUI) which presents information to a user and receives input selections from the user. Examples of the input module 32 are depicted in greater detail in FIGS. 6 and 7. The input module 32 includes a device body 36 which supports the graphical display 34. The input module 32 further structurally includes a bracket 38 connected to the body 36. In an embodiment, the bracket 38 is perpendicular to the body 36 and the bracket 38 is configured to be secured to a top of the door 16 while the body 36 is configured to extend in a dimension parallel to the face of the door 16. In this manner, the input module 32 is configured to engage two surfaces of the door 16. In an embodiment, a back of the body (e.g. the side of the body opposite the graphical display 34) is configured to engage the outer surface of the door 16. The bracket 38 further includes a mounting assembly 42 which in the exemplary embodiment depicted and described herein includes a pair of holes and threaded fasteners which extend therethrough and into the door 16 to secure the input module 32 to the door 16.

Figure 4:
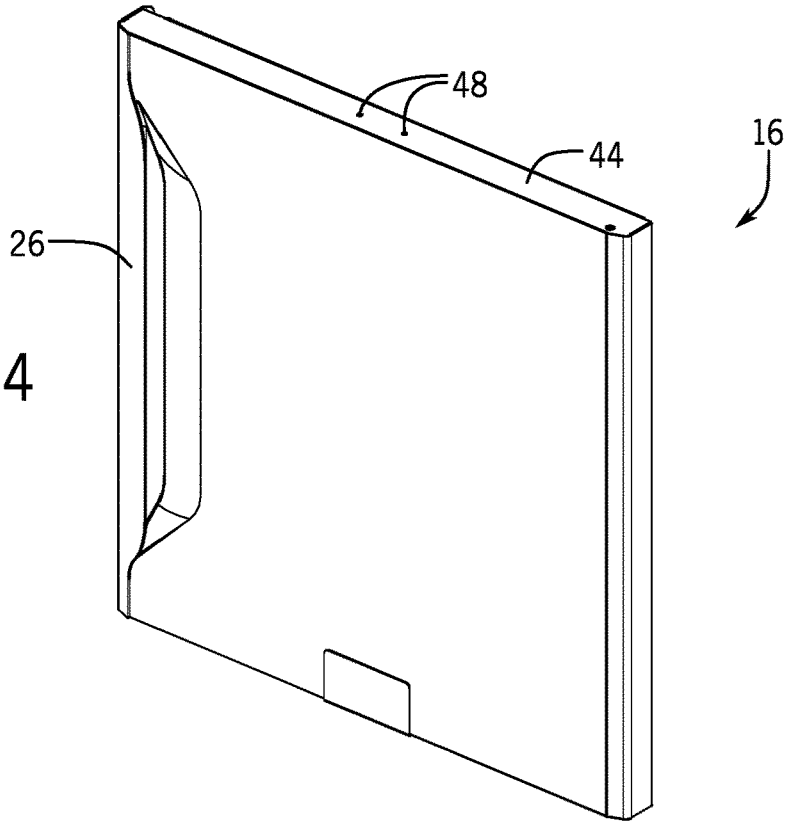
FIG. 4 is a top perspective view of an exemplary embodiment of a freezer door.
Figure 5:
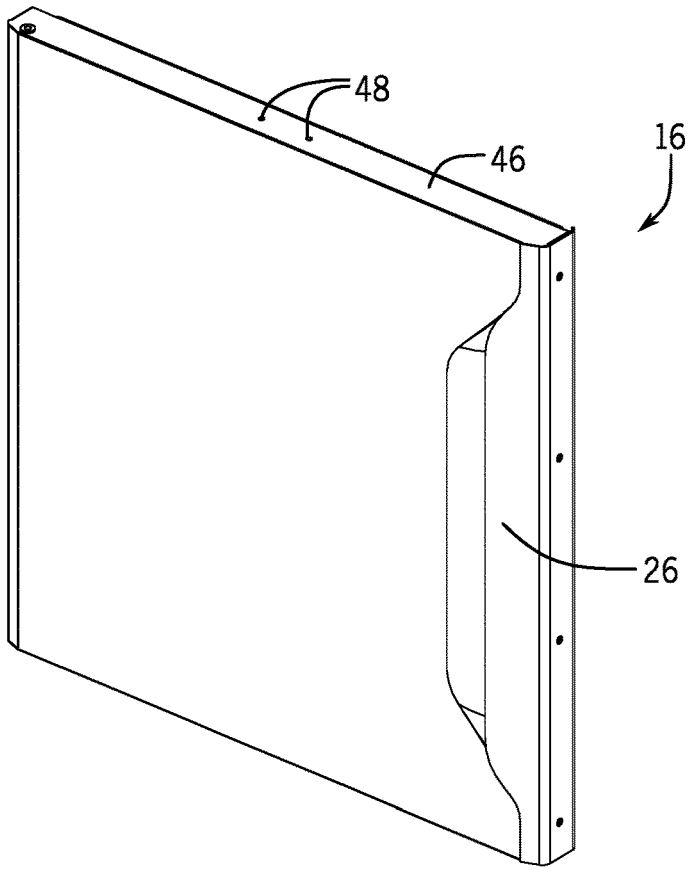
FIG. 5 is a top perspective view of the freezer door in a reversed orientation.
Figure 6:
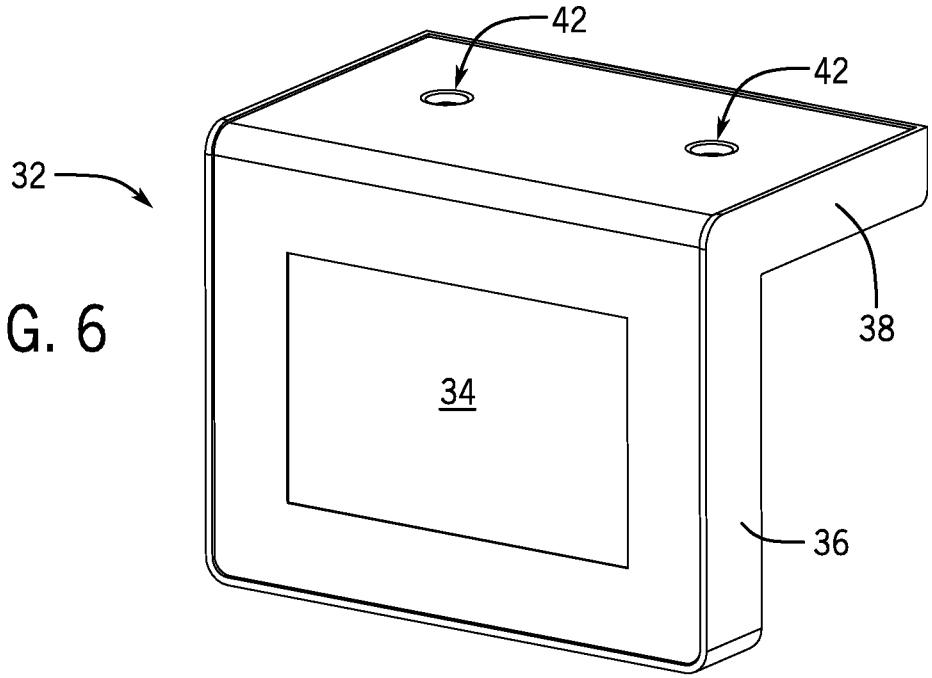
FIG. 6 is a front perspective view of an interface module.

As best depicted in FIGS. 4 and 5, the door 16 includes mounting holes 48 in a top portion 44 of the door 16. This is depicted in FIG. 4. When the door 16 is rotated 180° for mounting for left handed opening, it can be seen that the bottom portion 46 of the door 16 is further provided with mounting holes 48. Thus, the input modules 32 may be similarly mounted to available mounting holes 48 of whichever end of the door 16 is positioned relative to the top of the cabinet 14 of the refrigeration device 12.

As is depicted in FIG. 2, a cover plate 52 may be removably mounted to the pair of mounting holes 48 not in use to secure the input module 32 to the door 16.

Figure 7:
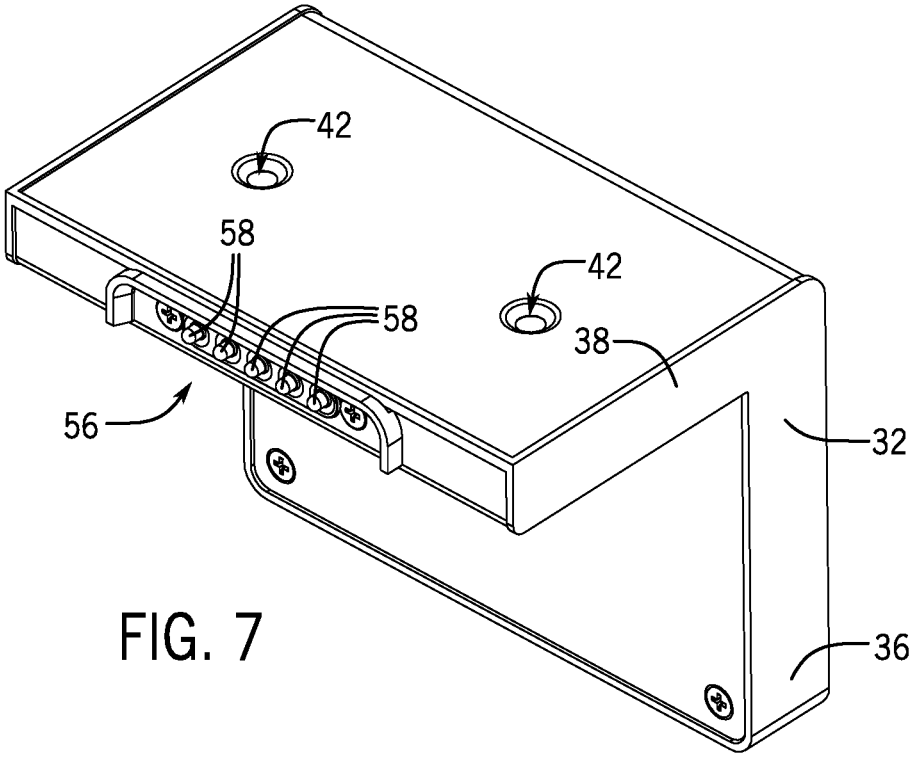
FIG. 7 is rear perspective view of an exemplary embodiment of an interface module.

As best depicted in FIG. 3, the cabinet 14 is provided with a connection plate 54 positioned at the top of the cabinet 14 at a location relative to that as provided by the mounting holes 48 of the door 16. As depicted in FIG. 7, the input module 32 includes an electrical connector 56. The electrical connector 56 is configured to be electrically and communicatively connected to the connection plate 54 of the cabinet 14. The electrical connector 56 exemplarily includes a plurality of connection pins 58 which are configured to connect to the connection plate 54. The connection plate 54 may be provided with a plurality of connection pads 62 and in an exemplary embodiment, the connection pins 58 are spring biased connection pins which engage respective connection pads 62 and biasing springs (not depicted) associated with each of the connection pins 58 bias the pins 58 in the direction of the connection pads 62 to maintain electrical and/or communicative connection therebetween. In another embodiment, although not depicted, the connection plate 54 may include a plurality of connection holes which are configured to receive at least a portion of the respective connection pins 58 to facilitate electrical and communicative connection. It will be recognized that in still further embodiments, the connection pins 52 may be located on the cabinet 14, or other forms of contact electrical and communicable contact between the input module 32 and the cabinet 14 may be used. In embodiments this connection may be near-field, inductive, electromagnetic, or other similar connective solutions. In exemplary embodiments the connection is able to conduct/transmit energy and data.

Figure 8:
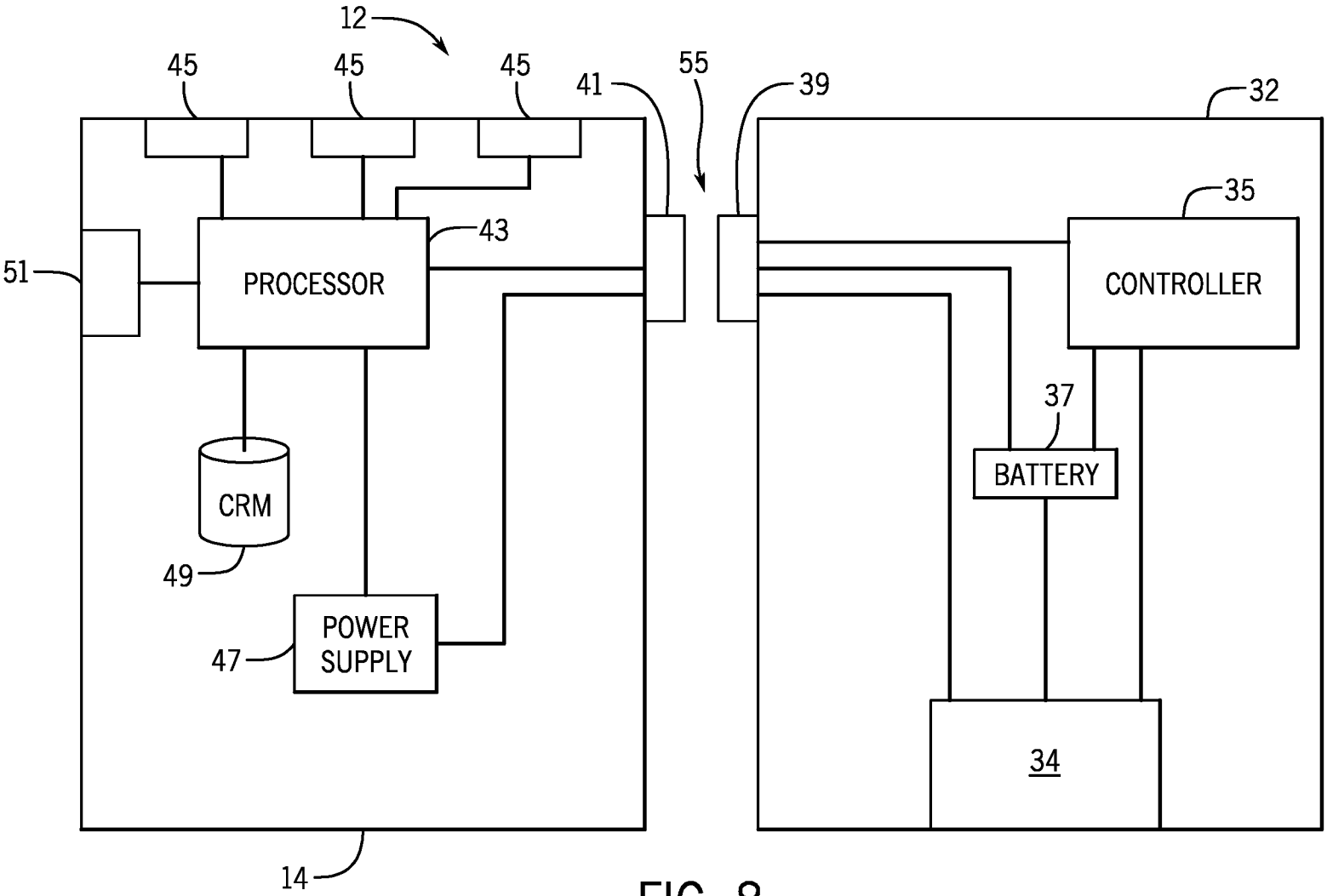
FIG. 8 is a system diagram of an exemplary embodiment of electrical components of a refrigeration device.

FIG. 8 is a system diagram of an exemplary embodiment of electrical components of a refrigeration device 12. The input module 32 includes a graphical display 34 as previously described. In an exemplary embodiment, the graphical display 34 is a touch-sensitive graphical display which additionally operates as a user input device to receive user input and controls to the refrigeration device 12 and/or the refrigeration system 10 as described herein. The input module 32 is communicatively and/or electronically connected to the cabinet 14 through a connection interface 55. The connection interface 55 exemplarily includes a input module connection 39 and a cabinet connection 41. As described, the input module connection 39 may be a electrical connector 56 with a plurality of connection pins 58 and the cabinet connection 41 may be a connection plate 54. However, as also previously described, the connection interface 55 may be implemented in a variety of other communicative and/or electrical connections between these components.

In operation, the control, communication, electrical supply, and other functionality may be provided by electronics located within the cabinet 14. When the door 16 is closed and the electrical connector 56 of the input module 32 is connected with the connection plate 54 then the input module 32 is supplied with electrical energization from the electronics of the cabinet 14 as well as additional control, operation and/or functionality by way of communicative connection between the connection plate 54 and the electrical connector 56. In an exemplary embodiment, a processor 43 positioned in the cabinet 14 provides operation and control of the graphical display 34 to present a GUI. This operation and control can include the presentation of the functions and features as described in further detail herein. In another embodiment, the input module 32 may additionally include a controller 35, which may be a processor and/or a graphical display drives, e.g. battery 37 and an energy storage device. The energy storage device may exemplarily be a battery 37, but may also be a super capacitor or another energy storage device as will be recognized by a person of ordinary skill in view of the present disclosure. This controller 35 of the input module 32 may primarily operate to control the graphical display 34 and to communicate instructions to and from the controller of the cabinet 14. In a still further embodiment, the input module may include one or the other of the battery 37 and the controller 35. The embodiments may facilitate partial functionality of the input module 32 when connection interface 55 is disconnected.

When the door 16 is opened, the electrical connector 56 is disconnected from the connection plate 54 and the input module 32 may be operated in a low power mode, exemplarily with reduced functionality and/or reduced brightness of the graphical display 34. In a first exemplary embodiment, the graphical display 34 may be operated to present the GUI in a simplified and/or black and white mode at a reduced brightness. In another exemplary embodiment, the graphical display 34 may be an electronic ink or other persistent electronic display that maintains a visual output in the absence of power. In an exemplary embodiment, the graphical display 34 may be operated to present a GUI of reduced functionally, for example to provide an indication that the door is open, a time, and/or a last recorded temperature. In a still further exemplary embodiment, the graphical display 34 may be operated to present a GUI with an elapsed time that the door has been opened.

Upon reclosing the door 16 and thus reconnecting the electrical connector 56 with the connection plate 54, the power supply is provided again to the input module 32 and the input module 32 may be returned to full operation of the graphical display 34 and functionality. This may additionally recharge the energy storage device of the input module 32.

The cabinet 14 further includes a variety of sensors 45, as will be described in further detail herein, may be arranged relative to components of the cabinet 14 so as to monitor the condition within the cabinet, for example temperature or humidity; conditions outside of the cabinet, for example temperature, humidity, or ambient light; or items within the cabinet, for example particular foods items or containers; and/or the function of components of the cabinet 14, for example the compressor. The sensors 45 provide their respective sensor signals to the processor 43 which the processor may then act upon as described herein, for example to present information on the graphical display 44.

The cabinet 14 further includes a power supply 47, which may exemplarily be configured to receive electrical mains power. The power supply 47 provides this power to the processor 43, and is also connected to the cabinet connection 41 in embodiments to provide power through the connection interface 55 to the graphical display 34, controller 35, and/or battery 37 of the input module 32. The cabinet 14 further includes a computer readable medium 49 which is either integrated with the processor 43 or communicatively connected to the processor 43. Computer readable code is stored upon the computer readable medium 49 and the processor 43 accesses the computer readable code stored thereon and upon execution of such computer readable code, the processor 43 carries out the functions as described in further detail herein. The processor 43 is also connected to a wireless communication device 51 which, as described in further detail herein, facilitates communication between the cabinet 14, particularly the processor 43 of the cabinet 14 with other devices of the refrigeration system 10.

Referring back to FIG. 1, FIG. 1 depicts an exemplary embodiment of a refrigeration system 10 which includes a plurality of refrigeration devices 12 as described in further detail above. It will be recognized that the refrigeration system 10 may use more, fewer, and/or as other refrigeration devices than those depicted or described herein in view of the present disclosure.

The refrigeration system 10 includes a refrigeration management system 64 to which one or more of the refrigeration devices 12 are communicatively connected. The refrigeration devices 12 exemplarily include communication apparatus, for example to support wired or wireless communication. In exemplary embodiments, wireless communication may be used, such wireless communication exemplarily employing radio frequency (RF) communication, while a person of ordinary skill in the art will recognize that other platforms for wireless communication, including, but not limited to, optical communication and/or cellular communication may be used. Additionally, it will be recognized that any of a variety of communication protocols may be used to facilitate the communication both between refrigeration devices 12 as well as between refrigeration devices 12 and the refrigeration management system 64. Such communication protocols may include WIFI, BLUETOOTH, or others. Additionally, a mobile computing device 66, for example a smart phone, tablet, or laptop computer may also be communicatively connected to any of the refrigeration devices 12 and/or the refrigeration management system 64.

The refrigeration system 10, as depicted in FIG. 1, may include refrigeration devices 12 that include input modules 32 as described above and include refrigeration devices 12 that do not include input modules. It will be recognized from the previous disclosure that other embodiments and locations of input modules on the refrigeration devices may be used within the refrigeration system 10. The refrigeration devices 12 are exemplarily communicatively connected to other refrigeration devices 12 and to the refrigeration management system 64. Data can be gathered from and exchanged with the refrigeration device 12 through these communicative connections with other components of the refrigeration system 10. In this manner, the refrigeration device 12 may be remotely monitored and controlled through user interaction with another component of the refrigeration system 10. By way of the communicative connections between the refrigeration devices 12 with each other and with a mobile computing device 66 and/or the refrigeration management system 64, a refrigeration device 12' which does not include an input module 32, may be accessed, controlled, or have data collected as described in further detail herein. This remote access may be through an input module 32 of another refrigeration device 12, through the mobile computing device 66, or through a work station 68. Communicatively and operatively connected to the refrigeration device 12' through the refrigeration management system 64. The work station 68 may include a computer, a graphical display and an input device. In this manner, additional user input and data reporting functionality may be provided relative to the refrigeration device 12' for example to view inventory, temperature, or other functional profiles, or to adjust operational or functional settings of the refrigeration device 12' using one of these other devices as the input device. It will be recognized that the work station 68 and the mobile device may be one and the same, and implemented with the same types of technology, including laptops and mobile devices.

Figure 9:
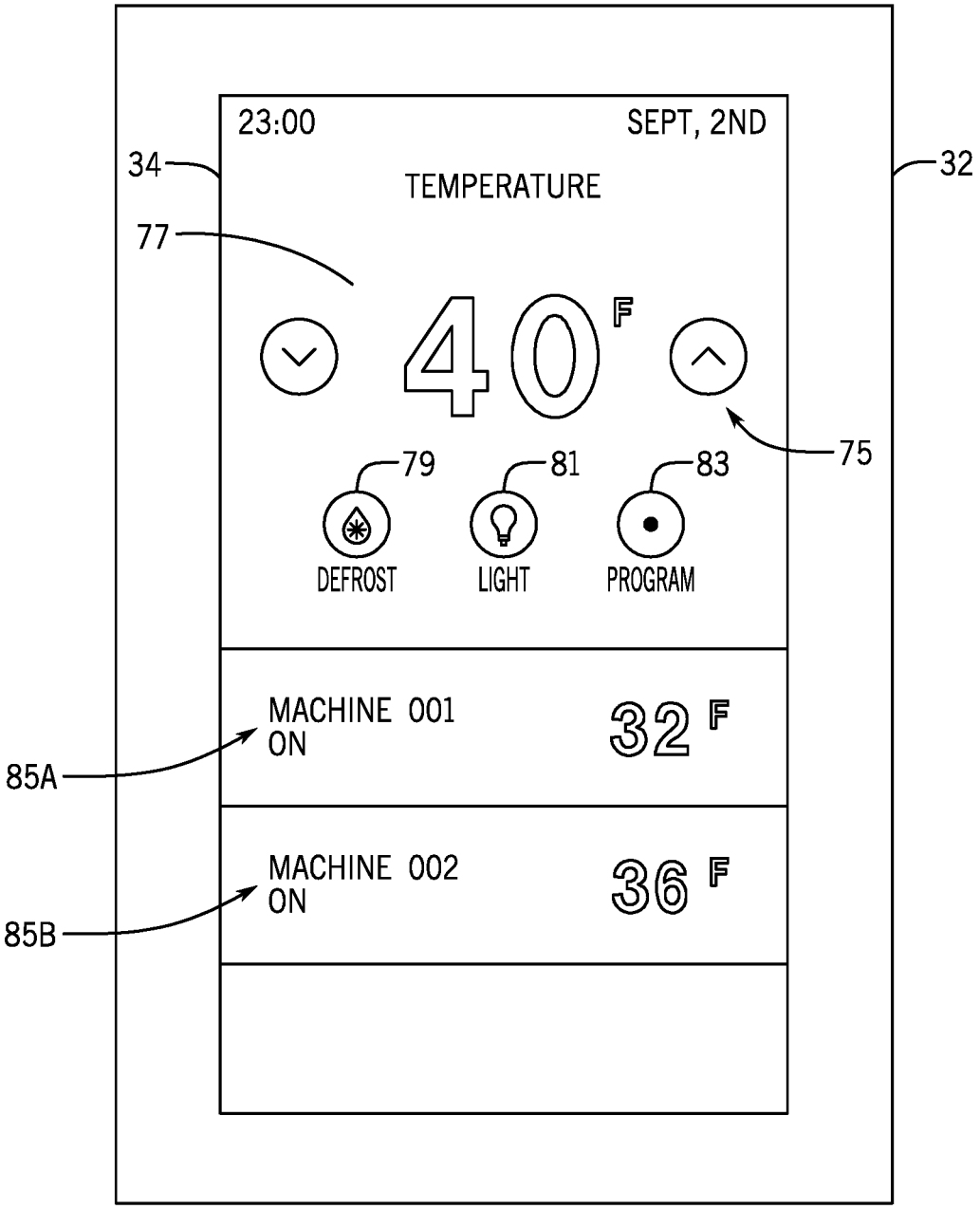
FIG. 9 depicts an exemplary embodiment of a graphical display of an input module.

FIG. 9 depicts an exemplary embodiment of a graphical display 34 of an input module 32. The graphical display 34 presents an exemplary embodiment of a graphical user interface (GUI) 75 which enables the graphical display 34 to be used at an input device. The GUI 75 exemplarily includes prompts for a user to provide temperature controls 77 or controls for defrost cycles 79. The GUI 75 further provides for lighting control 81 to control the lighting either within the interior and/or exterior of the refrigeration device. The GUI 75 provides for program or other operation customization control 83 to adjust other aspects of the operation of the refrigeration device, including, but not limited to energy efficiency controls of the display and/or refrigeration device, wireless communication connections, audio or visual alarms, diagnostic temperature measurements, diagnostic pressure measurements, inventory management, display configuration or settings management, and/or time and date information. The GUI 75 may further provide for on/off controls of the refrigeration device. In an exemplary embodiment, the input module 32 and the graphical display 34 may be communicatively and operationally connected to other devices within the refrigeration system 10. In such an exemplary embodiment, a single input module 32 and graphical display 34 may be used to control multiple refrigeration devices. To facilitate such an example, the GUI 75 may present status or other operational data regarding one or more refrigeration devices from within the refrigeration system in the GUI 75. For example, device status reports 85*a* and 85*b* provide the operational status ("on") and a current temperature of two different machines in the refrigeration system.

Figure 10:
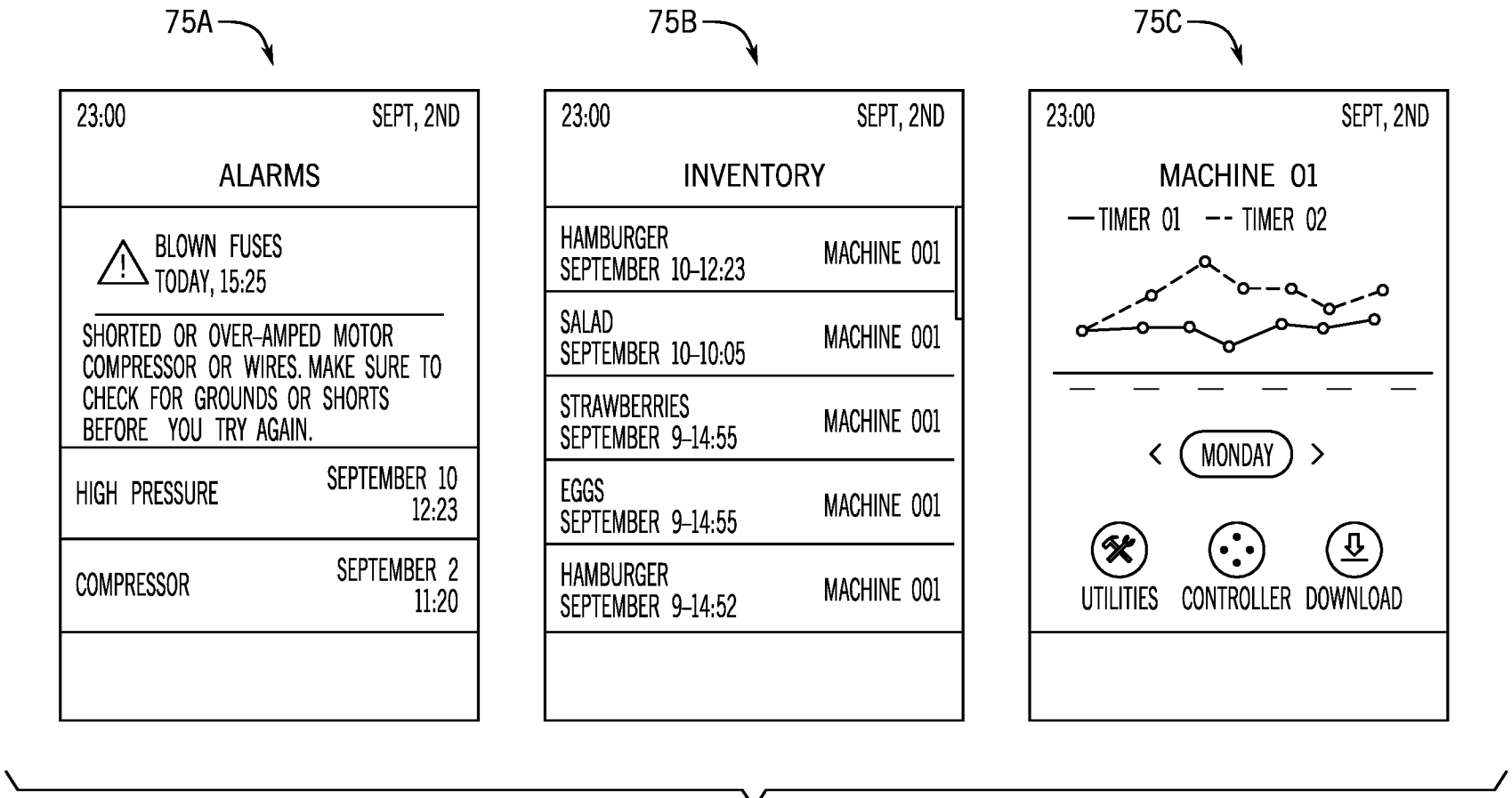
FIG. 10 depicts exemplary embodiments of graphical user interfaces for the graphical display.

FIG. 10 depicts additional exemplary embodiments of graphical user interfaces 75*a*-75*c* which may be presented on the graphical display 34 of an input module 32. GUI 75*a* presents alarms, for example alarms that relate to the operation of the refrigeration device itself, as exemplarily presented, the alarms may indicate blown fuses, high pressure or compressor malfunction. The alarms may provide a time and date of the alarm and a detailed description of the alarm as well. The inventory GUI 75*b* exemplarily presents an up to date inventory of the food items and/or containers found within a particular refrigeration device or devices. The inventory GUI may present the inventory of a particular refrigeration device or may present a list of all of the refrigerated foods items with an identification of a specific refrigeration device in which particular items are located. The inventory GUI may further present an identification of when that food item was first placed in the refrigeration device, an elapsed time that the food item has been in the refrigeration device, or an expiration date of the food item. Data GUI 75*c* exemplarily presents data as gathered from one or more sensors of a refrigeration device or refrigeration devices and presents such information in a manner that is relevant and actionable to a user of the refrigeration device. For example, as depicted in FIG. 10, the data GUI 75*c* may present a graph with one or more temperature measurements these temperature measurements may be compared to one another and exemplarily may represent temperature measurements interior and exterior of the refrigeration device or may represent temperature measurements in two or more different locations of the refrigeration device. This data may be presented over time, for example on a daily or weekly basis while the example provided in FIG. 10 presents temperature data, it will be recognized that other forms of data including a display of two or more different data types (e.g. temperature and humidity) may also be presented. The data GUI 75*c* further provides for transmission and/or download of the data recorded by the refrigeration device and control to further analyze the data or to adjust parameters or control or operation of the refrigeration device based upon the presented data. A person of ordinary skill in the art will recognize other features as may be exemplarily presented or carried out in user interfaces of additional embodiments from the present disclosure.

In an exemplary embodiment of a refrigeration device 12 for use with refrigeration system 10, the refrigeration device 12 includes a variety of sensors and/or components which may be used to provide the functionalities as described in further detail herein. A plurality of sensors 70 may be positioned within and around the compartment 18. In an exemplary embodiment, the sensors 70 may be temperature sensors and/or humidity sensors. It will recognized that other forms of sensors 70 may also be used within the scope of the present disclosure. By positioning sensors 70 at various locations relative to the compartment 18, gradients or profiles of the sensed parameters may be calculated based upon the inputs from the sensors and the relative locations of the sensors 70 within the compartment 18. In an exemplary embodiment, this data may be provided to the refrigeration management system 64 and/or processed and calculated in a processor of the refrigeration device 12. It will be recognized that in a communicatively connected system, the calculations and processing of data as described herein may be performed at the refrigeration device 12 itself, or at the refrigeration management system 64 or distributed therebetween.

In an exemplary embodiment, a profile and/or gradient of the temperature within the compartment 18 may be calculated and reported. In still further exemplary embodiments, the changes in this profile or gradient may be analyzed and detected with respect to particular events, for example door openings and removal or placement of food products within the compartment. Detection of these events can help to inform and contextualize the sensor readings and the temperature and/or humidity profiles or gradients calculated therefrom. In exemplary embodiments, events such as detected door openings or food placements may affect the temperature and/or humidity profiles or gradients calculated from the sensors in known manners. Placement of an anomalous temperature (e.g. hot) food item may locally raise the temperature within the cabinet 18 while other portions of the cabinet experience little or no change. Similarly opening of a door may increase temperature or humidity within the cabinet, but again only in the regions closest to the door.

In an exemplary embodiment, a door opening may be detected based upon disconnection between the electrical connector 56 of the door 16 and the connection plate 54 of the cabinet 14. It will be recognized that other types of door status sensors or systems may be used to detect a door opening event, including magnetic, conductive, inductive, or capacitive sensors. In an exemplary embodiment, the combination of the additional information of door opening events and/or product inventory as will be described in further detail herein with the temperature and/or humidity measurements, profiles, and gradients as calculated may be used to more efficiently operate compressor cycling decisions and/or initiation of defrost procedures. In a merely exemplary and non-limiting embodiment, opening of the door 16 may cause a temporary change in the environment within the compartment 18, for example an increase in humidity or an increase in temperature, which may temporarily cross a temperature or humidity threshold which would initiate a compressor or defrost operation, yet if the door is only opened briefly, upon closing the door the environment may reestablish an equilibrium which is still within acceptable ranges without the need to use energy on an additional compressor or defrost operation. Similarly, the introduction of a hot food item into the cabinet may create a local increase in temperature, which if close to a single sensor used to determine cabinet temperature may unnecessarily trigger a refrigeration cycle. Additionally, the system may operate knowing that upon the occurrence of one particular event (e.g. a door opening or hot food placement) that one or more sensor locations within the compartment 18 may be temporarily more reliable for determining the proper and energy efficient operation of the refrigeration device. In such a combination of events, the processor of the refrigeration device 12 may rely more heavily upon the information obtained from those one or more sensors for a limited time duration after such a detected event.

The refrigeration device 12, may further include one or more lights 72 in the compartment 18, such lights may exemplarily be LED lights. In exemplary embodiments, the lights 72 may be controlled as to a light intensity and/or light duration (e.g. a length of time that the light 72 is operated after the door is opened) are functions that may be controlled by user inputs to the input module 32 of the refrigeration device, or controlled through the mobile computing device 66 or refrigeration management system 64. In still further exemplary embodiment, an ambient light sensor 74 may be provided in or near the compartment 18 and the light 72 operated, for example, a light intensity of the light 72 controlled based upon the surrounding ambient light.

Exemplary embodiments of the refrigeration device 12 may further include a camera 76 directed to the interior of the compartment 18. The camera 76 may exemplarily be used in an embodiment of inventory management and control within the refrigeration system 10 as described in further detail herein. In an exemplary embodiment, the camera 76 may provide pictures of the interior of the compartment 18, particularly when the door 16 is closed. The camera 76 may exemplarily acquire still images or video images and provide this image data to the refrigeration management system 64 which may further operate in conjunction with an inventory management system 80. The inventory management system 80, in conjunction with the refrigeration management system 64, may identify the food containers 78 based upon image recognition and/or identification processing of the image data to provide a notation in the inventory management system 80 and/or at the refrigeration management system 64 of the food containers 78 located within the compartment 18 of the refrigeration device 12. As noted above, this can include the specific location of a food container (or food item) within the compartment 18. The use of the contents of the container (as exemplified by removal from the refrigerator) and the length of time that the container is in the refrigerator can be tracked once the food container is identified. In an exemplary embodiment, the list of the food containers 78 presently in the compartment 18 may be exemplarily provided on the graphical display of the input module 32 so that a user is made aware of the contents of the refrigeration device without having to open the refrigeration device. This promotes more energy efficient operation and use of the refrigeration device by limiting unnecessary door openings. In another embodiment, the image data as acquired by the camera 76 may be presented on the graphical display 34 of the input module 32. Thus, user is able to see inside the refrigeration device prior to opening the door 16.

In a still further exemplary embodiment, the food containers 78 are equipped with inventory RFID tags 82. The RFID tags 82 associated with the food container 78 may be sensed, for example by the communication system of the refrigeration device 12 and/or with a dedicated RFID sensing circuitry of the refrigeration device 12. The inventory RFID tags 82 may exemplarily be single use and replaced along with replacement of disposable food containers 78, or may be readable/writable and may be operated in conjunction with the inventory management system 80 to be updated with information, including, but not limited to food located within the food container 78, a most recent refill date, a "use by" date, and/or a date of the last time the food container 78 was cleaned. It will be recognized that the single use inventory RFID tags 82 may include similar information regarding an associated single use food container 78. In embodiments, information from the inventory RFID tags 82 sensed within the refrigeration device 12 may be similarly used to present a list of food containers 78 located within the refrigeration device 12 to the user on the graphical display so that the user can check the inventory of food containers without having to open the door 16. In a still further exemplary embodiment, the refrigeration management system 64 through use of the inventory management system 80 may provide alarm or warnings either to a remotely located workstation 68, to the graphical display of the refrigeration device 12, or to one or more mobile computing devices 66. The alarms or notifications may include that food in a particular food container has reached expiration, is nearing expiration requires refill or cleaning. These alerts can provide better notification of inventory management needs, prompting a user to take necessary remedial action, for example disposal of expired food product, cleaning of containers, or ordering additional inventory of particular food.

In a merely exemplary embodiment and non-limiting embodiment, the refrigeration device 12 may exemplarily store "child size" single serving containers of milk. An inventory RFID tag located on each of these containers is sensed by the refrigeration device, providing a current count of remaining single serving containers of milk to the input module 32 of the refrigeration device 12 for presentation on the graphical display 34, as well as two the refrigeration management system 64, and exemplarily onto the inventory management system 80. Upon detection that a predetermined "low inventory" threshold is crossed, the inventory management system 80 may provide an alert or an automated request for additional inventory.

In still further exemplary embodiments, the cooling system (not depicted) of respective refrigeration devices 12 may further be equipped with sensors and/or monitors which collect data and can provide such data communicatively to the refrigeration management system 64. Those sensors and/or monitors may exemplarily include any of the above noted sensors/monitors for monitoring the environment within the compartment (e.g. temperature or humidity) or for identifying or tracking the items in the compartment (e.g. cameras or RFID tags). In exemplary embodiments, the refrigeration management system 64 is communicatively connected to a computer readable medium 84 upon which computer readable code is stored, such computer readable code when executed by a processor of the refrigeration management system 64, causes the refrigeration management system 64 to operate and perform the functions as described above and as further described herein. In exemplary embodiments, the cooling system of the refrigeration device 12 may include a current sensor (for example a Hall Effect sensor) that measures the current consumption of the compressor of the cooling system. In another exemplary embodiment, pressure sensors may be located in line with the compressor, for example to respectively measure low side and high side pressure within the cooling system. In a still further exemplary embodiment, temperature sensors measure the temperature of the compressor, coil, or other component. This data may be provided to the refrigeration management system 64 through the communicative connection along with, or in addition to, the exemplary temperature and/or humidity measurement within the compartment 18 of the refrigeration device 12. The refrigeration management system 64 may use this data to evaluate the operation and function of the cooling system and/or refrigeration device 12 as a whole. For example, changes in the current consumption of the compressor can indicate compressor failure, degradation of operation, or other diagnostic conclusions. This can similarly be provided with the high side and low side pressure, component temperatures, and/or in combination with the current consumption. Thus, the refrigeration management system 64 can analyze the received operational data from each of the refrigeration devices 12 so as to be able to provide alarm reporting at 86 of any alarm, malfunction, or needs for service and/or maintenance. In one exemplary embodiment, a change in current consumption, temperature, and/or pressure may indicate the need for maintenance, for example cleaning the condenser coils of the refrigeration device. In the event of service and/or maintenance, a service/maintenance system 88 may automatedly schedule a service request to a service provider and/or order components for service of maintenance, for example consumables such as filters or replacement components, for example compressor, evaporator coil, or the like, the need for replacement of which may be detected and determined by the refrigeration management system in view of the data provided from each of the refrigeration devices.

In a still further exemplary embodiment, peak energy demand at a food service location may exemplarily be managed by coordinated operation of the compressors of multiple refrigeration devices 12 at a single location. By coordinating the on/off cycling of the compressor of the refrigeration devices, and alignment of cycles in which all or a majority of compressors are operating simultaneously, thus creating a peak in energy demand by the food service location can be limited or avoided which may reduce peak consumption energy premium costs or the like. For example, if a first refrigeration unit is currently operating in a refrigeration cycle, a second refrigeration unit may delay a refrigeration cycle, while the cabinet is within required and acceptable temperatures, in an effort to limit concurrent operation of refrigeration cycles by both refrigeration units.

In still further exemplary embodiment, the refrigeration management system 64 may be communicatively connected to a usage data storage 90 on a computer readable medium. The refrigeration management system 64 may collect usage data of each of the refrigeration devices 12, for example a record of all user interface interactions and inputs, a record of door opening, and exemplary coordination between a particular user interface interaction with one another as well as user interface interactions with door opening events. All of this may be stored at the user data storage 90 which may exemplarily be accessible by the operated and/or a device and/or system provider to gain further insight and acknowledge into use of the refrigeration devices in the field.

In a still further exemplary embodiment, the refrigeration management system 64, and particularly the communicative connections between the refrigeration management system 64 and the plurality of refrigeration devices 12 may be used to provide the refrigeration devices 12 with software and/or firmware updates either for the operation and control of the refrigeration device 12 itself, or updates to the input module and graphical user interfaces presented on the graphical displays of the input module. In exemplary embodiments, the refrigeration management system 64 may be communicatively connected to a point-of-sale (POS) system such that customer order information may be provided to one or more refrigeration devices or to push inventory updates out to the refrigeration devices. In an exemplary embodiment of a refrigerated dispenser, the refrigeration management system 64 can update the GUI presented on the user input device 32 to present an updated product offering. It will be recognized that while the refrigeration devices 12 are shown in general communicative connection to the refrigeration management systems 64 that in other exemplary embodiments, the refrigeration devices 12 may be connected to a hub or gateway locally to the refrigeration devices 12 in the food service location while the refrigeration management system 64 may be remotely located from the refrigeration devices 12 themselves. In still further exemplary embodiments, the refrigeration devices 12 may be directly connected to a communications network, for example, the Internet and communicate with the refrigeration management system 64 directly therethrough.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

The operational sequences described herein are representative of exemplary architectures, environments, and methodologies for performing novel aspects of the disclosure. While, for purposes of simplicity of explanation, the methodologies included herein may be in the form of an operational sequence and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A refrigeration device comprising:

a cabinet defining a compartment, the refrigeration device operable to control an environment within the compartment;

an input module comprising a graphical display;

a plurality of temperature sensors distributed about the compartment; and a processor that receives compartment data from the plurality of temperature sensors and calculates a temperature gradient within the compartment between the locations of the temperature sensors, the processor further operates an environmental control system of the refrigeration device based upon the temperature gradient, the processor is communicatively connected to and operates the graphical display to present compartment data in a graphical user interface of the input module.

2. The refrigeration device of claim 1, wherein the at least one sensor further comprises at least one humidity sensor and the processor operates the environmental control system further based upon the cabinet data of the at least one humidity sensor.

3. The refrigeration device of claim 1, wherein the processor further identifies localized temperature differences within the temperature gradient.

4. The refrigeration device of claim 3, further comprising identifying an anomalous temperature food item placed in the compartment based upon an identified localized temperature difference within the temperature gradient.

5. The refrigeration device of claim 1, further comprising at least one product identification sensor associated with the cabinet, wherein the processor produces an indication of the food products within the compartment based upon data from the at least one product identification sensor.

6. The refrigeration device of claim 5, wherein the at least one product identification sensor comprises a camera directed to the compartment, and the graphical display is operated by the processor to present at least one image of the compartment.

7. The refrigeration device of claim 5, wherein the at least one product identification sensor comprises an RFID sensor arranged relative to the compartment, wherein the RFID sensor communicates with the processor to provide indications to the processor of any detected RFID tags associated with food items placed in the compartment.

8. The refrigeration device of claim 7, wherein the processor further identifies food items in the compartment from the indications provided by the RFID sensor and uses the identified food items with the temperature gradient within the compartment to operate the environmental control system.

9. The refrigeration device of claim 5, wherein the processor produces a list of the food items located within the compartment and operates the graphical display to present the list.

10. The refrigeration device of claim 9, wherein a length of time that an identified food item is stored in the compartment is tracked by the processor and reported on the graphical display with the list of the food items located within the compartment.

11. The refrigeration device of claim 1, wherein the environmental control system comprises:

a compressor system operable to perform a refrigeration cycle to reduce the temperature within the compartment; and an operational sensor that senses a parameter of the compressor system, the operational sensor provides the sensed parameter to the processor and the processor determines a functional condition of the compressor system based upon the sensed parameter.

12. The refrigeration device of claim 11, wherein the operational sensor is at least one of a temperature sensor and a current sensor.

13. The refrigeration system of claim 12, wherein the operational sensor is a Hall effect sensor, and the processor produces an indication for compressor maintenance upon a detected increase in current drawn by the compressor system.

14. A refrigeration device comprising:

a cabinet defining a compartment, the refrigeration device operable to control an environment within the compartment;

an input module comprising a graphical display;

a door hingedly connected to the cabinet;

a door status sensor that operates to provide a signal to the processor indicative if the door is open;

a plurality of temperature sensors distributed about the compartment; and a processor that receives compartment data from the plurality of temperature sensors, calculates a temperature gradient within the compartment, identifies localized temperature differences within the temperature gradient and operates an environmental control system of the refrigeration device based upon the temperature gradient and based upon a detected door open event to adjust weight given to localized temperature differences within the gradient during the detected door open event, the processor is communicatively connected to and operates the graphical display to present compartment data in a graphical user interface of the input module.

* * * * *